US005259740A

United States Patent [19]

Youn

[11] Patent Number: 5,259,740

[45] Date of Patent: Nov. 9, 1993

[54] ROTARY COMPRESSOR

[75] Inventor: Young Youn, Suweon, Rep. of Korea

[73] Assignee: Samsung Electronics Co., Ltd., Suweon, Rep. of Korea

[21] Appl. No.: 953,253

[22] Filed: Sep. 30, 1992

[30] Foreign Application Priority Data

Sep. 30, 1991 [KR] Rep. of Korea ..... 91-17061

[51] Int. Cl.[5] ..... F01C 1/02

[52] U.S. Cl. ..... 418/58; 418/63; 417/902

[58] Field of Search ..... 418/58, 63, 209, 243; 417/902

[56] References Cited

U.S. PATENT DOCUMENTS

| | | | |
|---|---|---|---|
| 2,130,349 | 9/1938 | Kuchen | 417/902 X |
| 3,190,228 | 6/1965 | Grigan | 418/58 |
| 4,139,336 | 2/1979 | Hopkins | 418/209 |

FOREIGN PATENT DOCUMENTS

| | | | |
|---|---|---|---|
| 831453 | 9/1938 | France | 418/209 |
| 59-12188 | 1/1984 | Japan | 418/58 |

*Primary Examiner*—Richard E. Gluck

*Attorney, Agent, or Firm*—Burns, Doane, Swecker & Mathis

[57] ABSTRACT

A rotary compressor comprises a body forming an even number of parallel cylinders arranged equidistantly about an axis within a common plane oriented perpendicularly to the axis. An eccentric roller is rotatably mounted in each cylinder for sucking-in fluid through a respective inflow port and, once having compressed the fluid, discharging the fluid through a discharge port. A vane is disposed in each cylinder and is spring-biased against a respective roller to isolate the inflow port from the discharge port. A motor-driven drive shaft rotates about the axis and is coupled to the rollers by means of gears.

4 Claims, 3 Drawing Sheets

ROTARY COMPRESSOR

BACKGROUND OF THE INVENTION

A compression member 43 in a conventional rotary compressor is composed of a pair of cylinders 430A, 430B arranged in a stacked manner as shown in FIG. 4. Each cylinder 430A, 430B, respectively, comprises a compression chamber 431A, 431B in a center portion thereof and a suction opening 463A, 463B for intaking a refrigerant into the corresponding compression chamber 431A, 431B. In each compression chamber 431A, 431B is provided, respectively, a roller 46A, 46B for compressing the refrigerant in the compression chamber 431A, 431B. The rollers 46A, 46B are provided integrally with a lower end portion of a shaft 45. The rollers 46A, 46B are arranged opposite the adjacent eccentric portion of the axis of rotation of the shaft 45. The upper end portion of the shaft 45 is connected operatively to a motor (not shown). As power is given to the motor, the shaft 45 rotates and also the rollers 46A, 46B rotate. The rollers 46A, 46B compress the refrigerant taken into each compression chamber 431A, 431B, respectively. FIG. 4 illustrates the roller 46A in a suction state and the roller 46B in a compression state. The pressure difference between the suction area and the discharge area in the cylinder 430A is not canceled by the pressure difference between the suction area and the discharge area in the cylinder 430B. Thus, vibrational force arises in the compression member 43 and is transferred to the rollers 46A, 46B. Further, since the rollers 46A, 46B are formed integrally with the main shaft 45, the vibrational force in the rollers 46A, 46B transfers directly to the main shaft 45, thereby eccentrically rotating the main shaft 45. Furthermore, because the motor comprised by the rotor and the stator is disposed at the upper end of the main shaft 45, the non-constant gap between the stator and the rotor is maintained owing to the eccentric rotation of the main shaft. This causes the magnetic pull force in the motor to increase. Also, increased noise caused by such vibration together with an increased loss of efficiency in the motor are present.

SUMMARY OF THE INVENTION

This invention seeks to provide an apparatus to easily and effectively solve the above mentioned problems.

The object of the present invention is to provide a rotary compressor in which a plurality of cylinders are disposed in the same plane, to cancel vibrational forces generated by a pressure difference between a suction area and a discharge area in a compression chamber of the cylinder, thereby dampening noise produced by the cylinder and increasing the efficiency of the compressor.

According to the present invention, the rotary compressor comprises a housing, a motor disposed in the housing with a main shaft. A compression member is disposed in the housing with the main shaft extending therethrough and further comprising a plurality of cylinders. A roller is rotatively disposed in the each cylinder for compressing fluid such as a refrigerant taken-in through an inflow port. A vane is slidingly provided in a body of the cylinder and is always in contact with the roller. The roller is formed with an eccentric roller shaft placed in a parallel manner to the main shaft. The main shaft is coincidentally engaged in a meshing manner with the roller shafts.

The compression member further comprises an even number of at least four cylinders evenly spaced about the main shaft and disposed in the same plane oriented perpendicular to the axis of the main shaft.

In the above structure, as the main shaft rotates, the roller shafts coincidently rotate. In one cylinder of the cylinders, the pressure difference arises between the inflow portion in the cylinder and the discharge portion in the cylinder. The pressure difference is canceled with an other pressure difference arising in another cylinder which is arranged symmetrically around the center of the main shaft resulting in the rotary compressor to be silent and balanced. Due to the silent and balanced rotation of the main shaft the magnetic pull force in the motor can be decreased and the gap higher harmonics and the vibrational noise in the motor can also be decreased.

DETAILED DESCRIPTION OF THE PREFERRED EMBODIMENT

Figure 1:
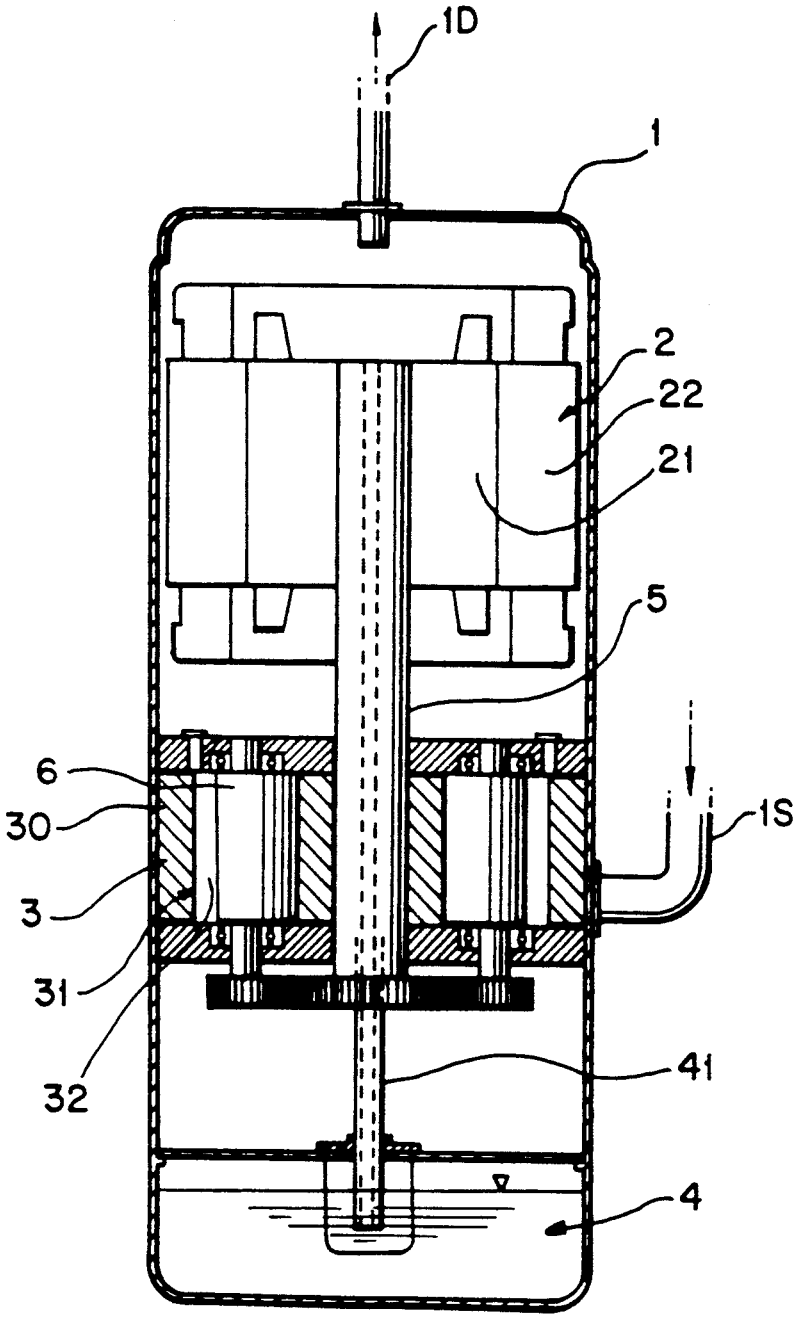
FIG. 1 is a longitudinal sectional view of a rotary compressor according to the present invention.

FIG. 1 illustrates the rotary compressor with the compression member formed in accordance with the preferred embodiment of the present invention. The rotary compressor is provided with compression member 3, a main shaft 5 extending through the compression member 3, a motor 2 connected to one end of the main shaft 5 and an oil reservoir 4 disposed at the opposite end of the main shaft, which are sealingly housed in a common housing 1 which is provided with a suction pipe 1S and a discharge pipe 1D. The compression member 3 comprises a plurality of cylinders 30 and each cylinder has a compression chamber 31 formed therein, a roller 6 rotatively disposed in the compression chamber 31 and a slidable vane 32 in continuous contact with the roller 31. The motor 2 is disposed at the upper end of the main shaft 5 which is operatively connected to the rotor 21. The upper end of oil intake tube 41 is coupled with the lower end of the main shaft 5, and the lower end of the oil intake tube 41 is immersed in the oil in the reservoir 4.

Figure 2:
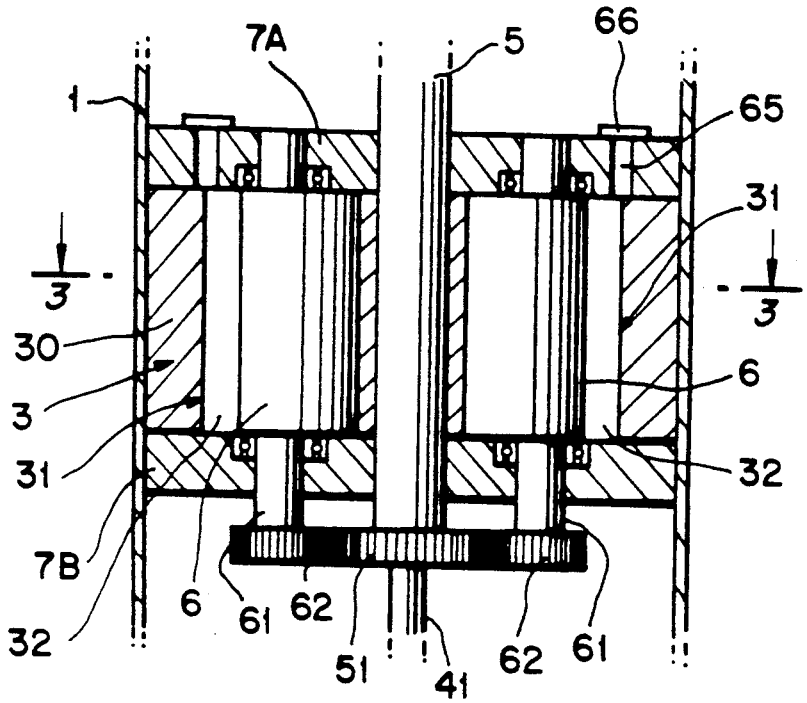
FIG. 2 is an enlarged fragmentary view of FIG. 1.
Figure 3:
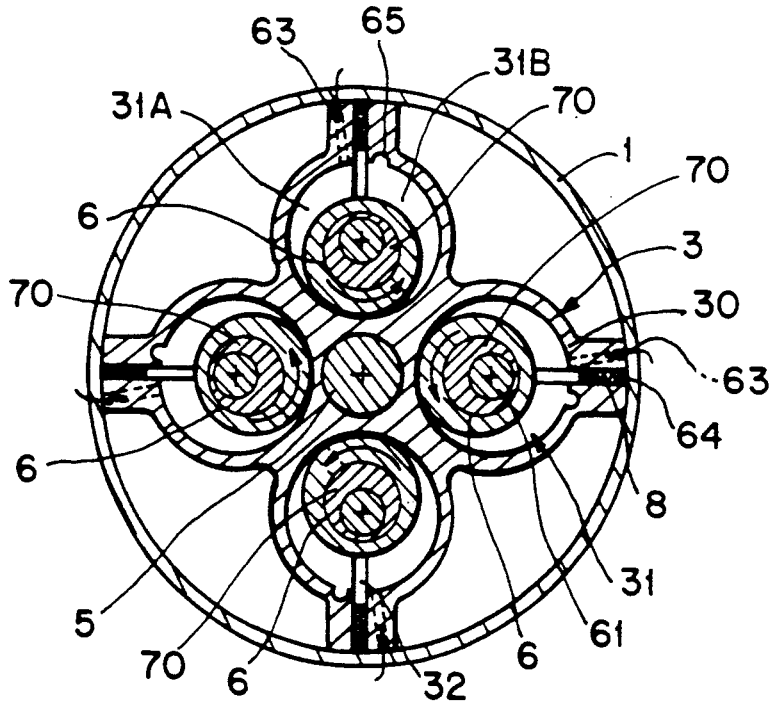
FIG. 3 is a cross sectional view taken along line 3—3 of FIG. 2.
Figure 4:
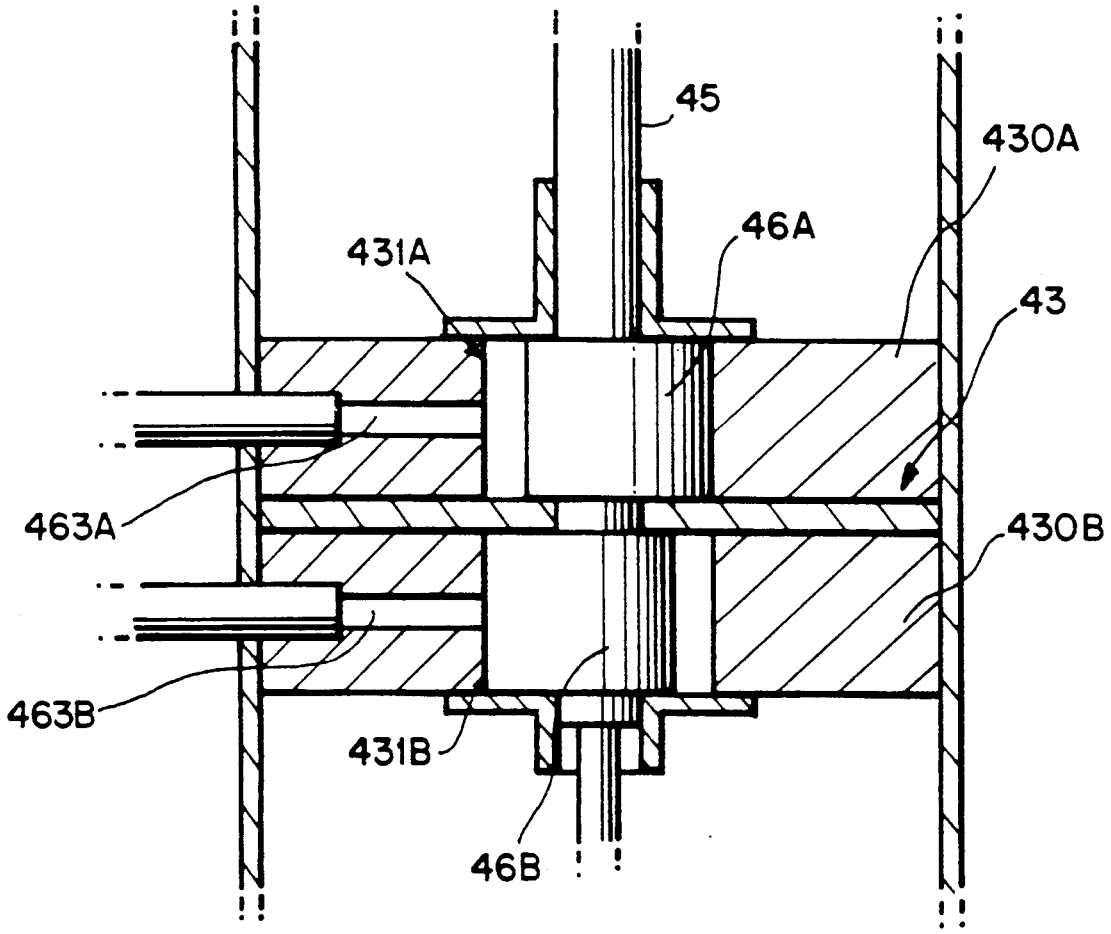
FIG. 4 (PRIOR ART)
FIG. 4 is a longitudinal sectional view of a rotary compressor according to the prior art.

In FIGS. 2 and 3, the compression member 3 according to the present invention comprises four cylinders 30 disposed in the same plane. The cylinders are equally spaced around the center of the main shaft 5. The roller 6 of compression chamber 31 is provided with a roller shaft 61 extending therethrough in an eccentric manner. An eccentric 70 is fixed to the roller shaft 61 and is freely movably disposed in the roller 6. The upper and lower ends of the roller shaft 61 are mounted using bearings to the upper and lower support plate 7A, 7B, respectively. The lower extended portion of the lower roller shaft 61 is provided with a driven gear 62 which meshes with a driving gear 51 formed on the corresponding portion of the main shaft 5 to coincidently rotate the roller 6 by the rotation of the main shaft 5, the roller shaft 61 and the eccentric 70.

In FIG. 3, the body of the cylinder 30 close to the wall of the housing 1 is provided with a suction port 63 for providing refrigerant from the accumulator (not shown) and a guiding slot 64 for slidably guiding the vane 32. The vertical vane 32 is always in contact with the roller 6 by the spring 8 provided in the guiding slot 64. The upper support plate 7A (FIG. 2) close to the wall of the housing 1, is provided with a discharge port 65 and a discharge valve 66 for discharging the compressed refrigerant from the compression chamber 31. FIG. 3 illustrates a state of intermediate compression, that is, one volumetric half 31A of the compression chamber 31 is in the suction state and other volumetric half 31B thereof is in the discharge state. All the great eccentric portions of each roller 6 are arranged so as to face each other with the shortest distance. Further, when the whole volume of the compression chamber is in the compression state, all the great eccentric portions of each roller 6 are arranged so as to face each other with the longest distance.

In operation, the oil in the reservoir 4 is pumped by the pressure difference between the discharged gas pressure from the discharge pipe 1D and through the oil intake pipe 41 as the main shaft 5 rotates. The oil feeding though the main shaft 5 is supplied to the place to be lubricated. Concurrently, as the main shaft 5 rotates, the rollers 6 in their respective compression chambers 31 rotate via the power transmission using the gears 51,62. The gas is drawn into the suction area 31A of the compression member 3 through the suction port 63. The gas confined in the suction area 31A (defined by the roller 6, the vane 32 and the wall near to the suction port 63 is progressively expanded. Whereas, the gas confined in the discharge area 31B (defined by the roller 6, the vane 32 and the wall near to the discharge port 65) is progressively compressed. During the above operation, in one cylinder, the pressure difference between the pressure of the suction area 31A and that of the discharge area 31B creates vibrational force in the compression member. However, a corresponding cylinder is positioned 180 degrees opposite the facing cylinder in order to cancel the vibrational force. In FIG. 3. the four cylinders are arranged in the same plane with the same degree of separation therebetween and thus the vibrational force of the right hand cylinder is canceled by that of the left hand cylinder, and the vibrational force of the top cylinder is canceled by that of the bottom cylinder. Further, since the main shaft 5 is separately provided with the roller 6, no minor vibrational force of the rollers 6 is directly transmitted to the main shaft 5. This results a constant gap between the rotor and the stator in the motor which decreases the magnetic pull force and the gap higher harmonics and magnetic noise.

In the embodiment of the present invention, through the compression member comprises four cylinders, this does not restrict the member of cylinders of the compression member. Thus more than four cylinders achieves the benefits of the present invention as long as the number is an even number of cylinders. Such structure achieves vibrational dampening.

What is claimed is:

1. A rotary compressor comprising:

a housing;

a motor disposed in said housing and connected operatively to a main shaft;

a compression member disposed in said housing and having said main shaft extending therethrough and comprised of a plurality of cylinders;

a roller rotatively disposed in said cylinder for each compressing a refrigerant taken through an inflow port formed in said cylinder;

a vane positioned in a body of each said cylinder with each said vane in continuous contact with a respective roller;

said roller formed with an eccentric roller shaft placed in a parallel manner to said main shaft; and said main shaft engaged coincidentally in a mechanical manner with said roller shafts.

2. The rotary compressor according to claim 1, wherein said cylinders are in the same plane oriented perpendicular to said shaft.

3. The rotary compressor according to claim 2, wherein one of said rollers is in a distal direction relative to said main shaft with others of said rollers placed in a distal position and one of said rollers is in a proximate direction relative to said main shaft with others of said rollers placed in a proximal position.

4. The rotary compressor according to claim 1, wherein said plurality of cylinders comprises four cylinders.

* * * * *